US007048810B2

(12) United States Patent
Petersen et al.

(10) Patent No.: US 7,048,810 B2
(45) Date of Patent: May 23, 2006

(54) METHOD OF MANUFACTURING HOT FORMED HIGH STRENGTH STEEL

(75) Inventors: Clifford W. Petersen, Missouri City, TX (US); Jayoung Koo, Bridgewater, NJ (US); Narasimha-Rao V. Bangaru, Annandale, NJ (US); Michael J. Luton, Bedminster, NJ (US)

(73) Assignee: ExxonMobil Upstream Research Company, Houston, TX (US)

( * ) Notice: Subject to any disclaimer, the term of this patent is extended or adjusted under 35 U.S.C. 154(b) by 151 days.

(21) Appl. No.: 10/253,129

(22) Filed: Sep. 24, 2002

(65) Prior Publication Data

US 2003/0098096 A1 May 29, 2003

Related U.S. Application Data

(60) Provisional application No. 60/354,088, filed on Oct. 22, 2001.

(51) Int. Cl.
*C12D 8/10* (2006.01)

(52) U.S. Cl. ..... 148/320; 148/909; 148/598; 148/649; 148/654; 148/593

(58) Field of Classification Search ..... 148/654, 148/660, 649, 593, 909, 598, 693, 320
See application file for complete search history.

(56) References Cited

U.S. PATENT DOCUMENTS 5,352,304 A * 10/1994 DeArdo et al. ..... 148/336
6,224,689 B1 * 5/2001 Koo et al. ..... 148/320
6,245,290 B1 * 6/2001 Koo et al. ..... 420/119
6,248,191 B1 * 6/2001 Luton et al. ..... 148/654
6,264,760 B1 * 7/2001 Tamehiro et al. ..... 148/336
6,288,183 B1 * 9/2001 Luo ..... 526/153

FOREIGN PATENT DOCUMENTS

JP 2001-140032 * 5/2001

OTHER PUBLICATIONS

George E. Dieter, Mechanical Metallurgy, second edition,, 1961, pp. 471-472.*
J.G. Henderson, Metallurgicla Dictionary, 1953, p. 173.*
Dieter, Jr., George E., *Mechanical Metallurgy*, McGraw-Hill Book Company, Inc., York, PA, 1961, pp. 455-462 and pp. 488-492.
Dieter, George E., *ASM Handbook*, vol. 20 Materials Selection and Design, ASM International, Materials Park, Ohio, 1997, pp. 692-693, 733.

* cited by examiner

*Primary Examiner*—Deborah Yee
(74) *Attorney, Agent, or Firm*—ExxonMobil Upstream Research Co. Law Department

(57) ABSTRACT

A method for processing a hot formed, high-tensile-strength steel having an ultimate tensile strength (UTS) of at least about 730 MPa (105 ksi) and excellent toughness to retain essentially all the strength and toughness is provided. This processing is needed for the fabrication of high strength fittings that are used in the construction of linepipe for transport of natural gas, crude oil, as well as other applications. Furthermore, the hot formed high strength steel may be weldable with a Pcm of less than or equal to 0.35.

19 Claims, 4 Drawing Sheets

Ferrite + Martensite

Ferrite + Martensite – Austenite

Martensite + Bainite

Ferrite + MA

METHOD OF MANUFACTURING HOT FORMED HIGH STRENGTH STEEL

RELATED U.S. APPLICATION DATA

This application claims the benefit of U.S. Provisional Application No. 60/354,088, filed Oct. 22, 2001.

FIELD OF THE INVENTION

The present invention generally relates to steel and the manufacturing of steel fittings and other components. More particularly, the invention relates to hot formed, high-tensile-strength steel components having excellent toughness and an ultimate tensile strength (ITS) of at least about 730 MPa (105 ksi).

BACKGROUND OF THE INVENTION

In pipelines for transport of natural gas and crude oil over long distances, a reduction in transportation cost has been a universal need, and efforts have focused on improvement of transport efficiency by increasing the maximum working pressure of the pipeline. The standard approach to increasing maximum working pressure involves increasing the wall thickness of commercially available linepipe. However, due to the increase in steel tonnage, this approach results in higher material costs, higher transportation costs, higher on-site welding costs, and a reduction in overall pipeline construction efficiency. An alternate approach is to limit the increase in wall thickness by enhancement of the strength of the linepipe material itself. For example, the American Petroleum Institute (API) recently standardized X-80 grade steel. "X-80" means a yield strength (YS) of at least 551 MPa (80 ksi). More recently, even higher strength steels suitable for use in pipelines have been developed that provide pipe with a yield strength of at least 620 MPa (90 ksi) and as high as about 965 MPa (140 ksi), but these steels have not yet been applied commercially. These new higher strength steels suitable for pipelines are made by the Thermo-Mechanical Controlled Rolling Process (TMCP), which imparts much of the strength and toughness by controlled rolling of the plate within specified temperature ranges followed by accelerated cooling, thus achieving a specific microstructure and grain size.

When a pipeline is constructed there is a need for non-regular shaped pieces of pipe called fittings. These pieces, when welded into the pipeline, enable a change in the pipeline direction (elbows or bends); joining of pipes of different diameters (reducers or expanders); or splitting a pipeline to permit flow in or out from two directions (Y and T shaped junctions). To ensure that the integrity of the pipeline is maintained, these special pieces must have the same burst capacity as the pipe used to make the pipeline.

At the present time, fittings with yield strengths of up to about 65 ksi to 70 ksi are available commercially. Further, there has been at least one case where X-80 fittings were made on a special order. For pipeline grades above X-70 (YS=70 ksi), commercially available fittings of comparable strength do not exist. Therefore, the approach presently used for higher strength pipelines (e.g., X-80 pipelines) is to use fittings of lower strength but make them with a wall thickness greater than that of the linepipe such that the burst capacity is maintained. The relationship between the wall thickness and burst capacity is shown below as equation 1:

$$T_w = \frac{P_b \times D}{2 \times UTS} \tag{1}$$

Wherein $T_w$ is the wall thickness of the pipeline (pipe or fitting), $P_b$ is the burst pressure of the pipeline, D is the outside diameter of the pipeline, and UTS is the ultimate tensile strength of the pipeline material. In a pipeline, pressure and diameter are essentially constant. Therefore, the wall thickness of the fitting, relative to the pipe wall thickness, must essentially be equal to the ratio of the ultimate tensile strengths as shown in equation 2:

$$T_{Fitting}=(T_{pipe})\times(UTS_{Pipe})/(UTS_{Fitting}) \tag{2}$$

Wherein $T_{Fitting}$ is the thickness of the fitting, $T_{Pipe}$ is the thickness of the steel linepipe, and UTS is the ultimate tensile strength of the respective material. There are some constraints to this approach, including codes restricting the amount of wall thickness mismatch between the pipe and fitting to a ratio of 1.5. This is done to minimize localized straining. Since X-70 is the highest strength fitting made on a commercial basis, pipes with strength above about X-100 cannot be welded directly to an X-70 fitting.

Thus the industry has two choices for pipelines using linepipe with a strength greater than X-100. One choice is to develop new, higher strength fittings which eliminates the wall thickness mismatch issue. The second choice is to use thicker wall fittings in combination with thick wall transition pieces to minimize the wall mismatch at each joint. While the second choice is feasible, it is not the most effective approach.

Many commercially available high strength steels are limited in their use, compared to lower strength steels, particularly in fracture critical applications, because they typically have lower fracture toughness (thus, limited defect tolerance). Pipes and fittings must have adequate fracture toughness. Toughness in steel may be evaluated by several different methods or criteria (e.g., the ductile-to-brittle transition temperature (DBTT) measured by the Charpy V-Notch (CVN) test, the magnitude of the absorbed CVN energy at a specific temperature, or the magnitude of the fracture toughness at a specific temperature as measured by a test like the crack tip opening displacement (CTOD) test or the J-integral test). All of these above referenced toughness testing techniques are known to those skilled in the art (See Glossary for definition of DBTT and CTOD).

In addition, there is a need for the steel to be weldable (i.e., the weldment is not susceptible to hydrogen cracking when conventional arc welding techniques such as gas metal arc welding and shielded metal arc welding techniques are used to produce the weldment and when preheating is limited to less than about 150° C.). To provide a weldable, hot formed high strength steel component, the total alloying content in the starting high strength steel of the present invention is preferably limited to a Pcm of less than or equal to 0.35 (See Glossary for definition of Pcm). Accordingly, there is a need for higher strength fittings and other components that have adequate fracture toughness and that can be formed from weldable steel. The present invention satisfies this need.

SUMMARY OF THE INVENTION

One aspect of the invention provides a method of hot forming high strength steel, having a yield strength of at least 689 MPa (100 ksi), to produce a high strength component, comprising: (a) heating the high strength steel to at least about 700° C. and no more than about 1100° C.; (b) hot forming the high strength steel to produce a desired component; (c) quenching the high strength steel component after hot forming at a rate greater than about 10° C. per second (° C./s) to a quench stop temperature lower than about 450° C. Furthermore, this invention provides hot formed high strength steel components having an ultimate tensile strength of at least about 723 MPa (105 ksi).

In another aspect of this invention the hot formed high strength steel may be weldable having a Pcm of less than or equal to 0.35. The hot formed high strength steel components are suitable for use as fittings that can be used in the construction of linepipe for the transport of natural gas, crude oil, and other applications.

BRIEF DESCRIPTION OF THE DRAWINGS

The advantages of the present invention will be better understood by referring to the following detailed description and the attached drawings in which.

DETAILED DESCRIPTION OF THE INVENTION

Figure 1A:
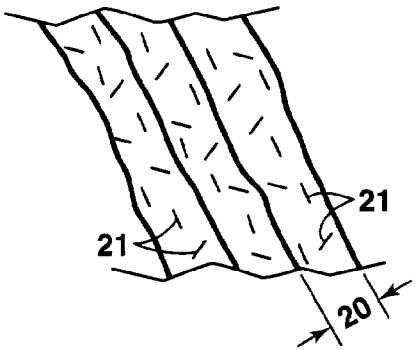
FIGS. 1A, 1B, 1C, and 1D are respectively schematic illustrations of lath martensite, lower bainite, degenerate upper bainite, and granular bainite.

High strength steels with superior yield strength of up to about 931 MPa (135 ksi) have been developed (see, e.g., U.S. Pat. Nos. 6,224,689, 6,228,183, 6,248,191). These new high strength steels were developed primarily for linepipe applications, but they can also be used for other applications. The new hot forming method, described below, was developed for use with these high strength steels. However, this hot forming method can also be applied to other high strength steels.

Table 1 illustrates the ratio of the fitting wall thickness to the pipe wall thickness for different combinations of grades of fitting and pipe steel. As Table 1 indicates, X-65 fittings could only be used with pipe steels up to a strength of X-100 without the need of a transition piece. However, using X-100 linepipe with X-65 fittings would be marginally acceptable. X-70 fittings could be used with steels up to X-100, and X-80 fittings could be used with steels up to X-120. An X-80 transition pipe with a wall thickness 1.5 times greater than that of the X-120 linepipe would also enable a pipeline to be built with an X-65 fitting.

TABLE 1

| | | Wall Thickness of Fitting to Pipe Wall Thickness Based on Grade | | | |
|---|---|---|---|---|---|
| Pipe Grade | | X-65 | X-65 | X-65 | X-100 |
| X-65 (77 ksi) | 531 MPa UTS | 1.00 | 0.94 | 0.86 | |
| X-70 (82 ksi) | 565 MPa UTS | 1.06 | 1.00 | 0.91 | |
| X-80 (90 ksi) | 621 MPa UTS | 1.17 | 1.1 | 1.00 | |
| X-100 (115 ksi) | 792 MPa UTS | 1.49 | 1.40 | 1.28 | |
| X-120 (135 ksi) | 931 MPa UTS | 1.75 | 1.65 | 1.5 | |

The shaded region is the range where standard grade fittings could be used without transition pieces (i.e., where the wall thickness mismatch is 1.5 or less). For steels greater than about X-100, the preferred approach would be to use a fitting with a strength equal to or greater than X-90 or 725 Mpa (105 ksi UTS) and having adequate fracture toughness. A new fitting with a UTS above the current maximum strength of fittings would require less steel, less welding and therefore, lower the cost.

A method has been developed for processing high strength steel to achieve a fitting with strength at least comparable to that of an X-90 material while maintaining substantially the same excellent fracture toughness of the starting material. In making fittings and other components, the material must be heated to high temperatures so that it can be formed into the desired shapes. During conventional hot processing, the heating degrades the important mechanical properties (strength and toughness) of the steel. High strength commercially available fittings of 448–483 MPa (65–70 ksi) UTS are typically made by a reheat, quench and temper process after hot forming. The problem associated with trying to make higher strength fittings by conventional methods is that the yield strength to ultimate tensile strength ratios get very large, and the fracture toughness diminishes. Preferably, the yield strength to ultimate tensile strength ratio should not exceed about 0.93.

The conventional approach to increasing fittings strength is to start with a lower strength steel (e.g., X-65), and after hot forming, hot process the formed product to achieve higher strength (e.g., X-80). This approach, as previously described, requires a reheat and then a quench and temper process. According to the present invention, an alternate approach is to start with a high strength steel (e.g., 827 MPa (120 ksi) YS), apply novel hot forming processes to form the fittings so as to retain in the as-formed fittings as much of the prior mechanical properties of the starting steel as possible (e.g., 690 MPa (100 ksi) YS) without the need for additional, post-forming heat treatment. The latter approach is the basis for the hot forming technique described below.

The initial high strength steel base plate or pipe should have a substantially uniform microstructure preferably comprising "predominantly" fine-grained lower bainite, fine-grained lath martensite, fine-grained degenerate upper bainite, fine-grained granular bainite or mixtures thereof. As used in describing the present invention, and in the claims, "predominantly" means at least about 50 volume percent. More preferably, the high strength steel base plate comprises predominantly fine-grained lower bainite, fine-grained lath martensite, or mixtures thereof.

Preferably, the fine-grained lath martensite comprises auto-tempered fine-grained lath martensite. The remainder of the microstructure can comprise upper bainite, pearlite, or ferrite. More preferably, the microstructure comprises at least about 60 volume percent to about 80 volume percent fine-grained lower bainite, fine-grained lath martensite, or mixtures thereof. Even more preferably, the microstructure comprises at least about 90 volume percent fine-grained lower bainite, fine-grained lath martensite, or mixtures thereof.

Figure 1B:
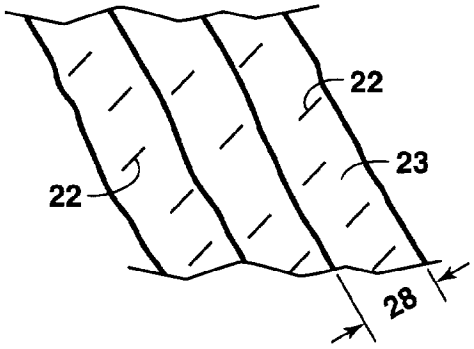
Figure 1C:
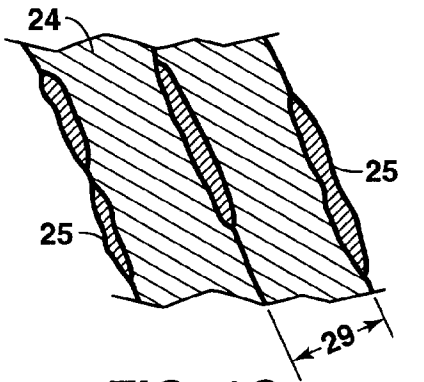
Figure 1D:
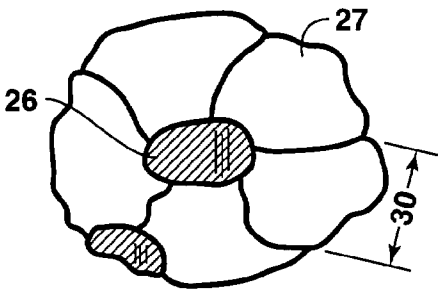

FIG. 1A is a schematic illustration of lath martensite, showing auto-tempered cementite 21. The average lath width of the lath martensite 20 in hot formed high strength steel according to this invention is preferably less than about 0.5 microns (μm). FIG. 1B is a schematic illustration of lower bainite, showing cementite 22 and bainitic ferrite 23. The average lath width of the lower bainite 28 in the hot formed, high strength steels according to this invention is preferably less than about 0.8 μm. FIG. 1C is a schematic illustration of degenerate upper bainite, showing bainitic ferrite 24 and martensite or martensite-austenite (MA) 25. The average lath width of the degenerate upper bainite 29 in the hot formed high strength steels according to this invention is preferably less than about 1.0 μm. FIG. 1D is a schematic illustration of granular bainite, showing martensite-austenite constituent 26 and bainitic ferrite 27. The average width of the bainitic ferrite in the granular bainite 30 in hot formed high strength steels according to this invention is preferably less than about 5 μm.

The starting high strength steel preferably has an ultra-fine microstructure with the average grain size, in the through thickness direction, of less than about 10 microns. The average grain size in the through thickness direction is the width or thickness of the prior austenite (the high temperature phase) grain measured along the through thickness direction of the plate or slab. This is the size of austenite prior to its phase transformation as it is cooled from the high temperature to ambient or other quench stop temperature in between.

Figure 2B:
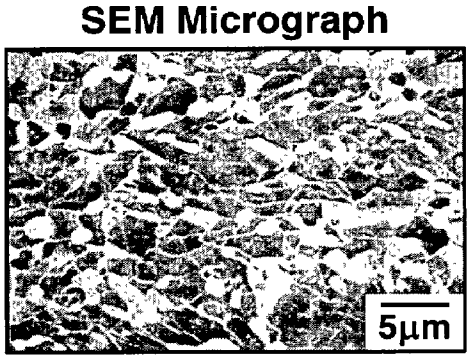
FIGS. 2A, 2B, and 2C illustrate the Charpy V-Notch toughness at −40° C., $vE_{-40}$, vs. ultimate tensile strength and the corresponding microstructures for a high strength steel processed to simulate conventional fittings manufacture.
Figure 2C:
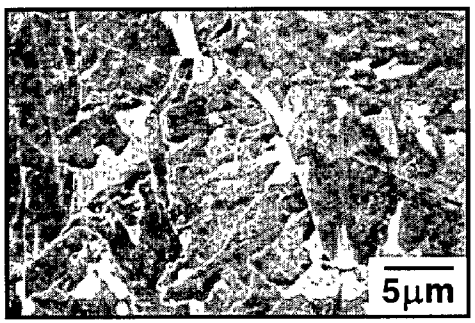
Figure 2A:
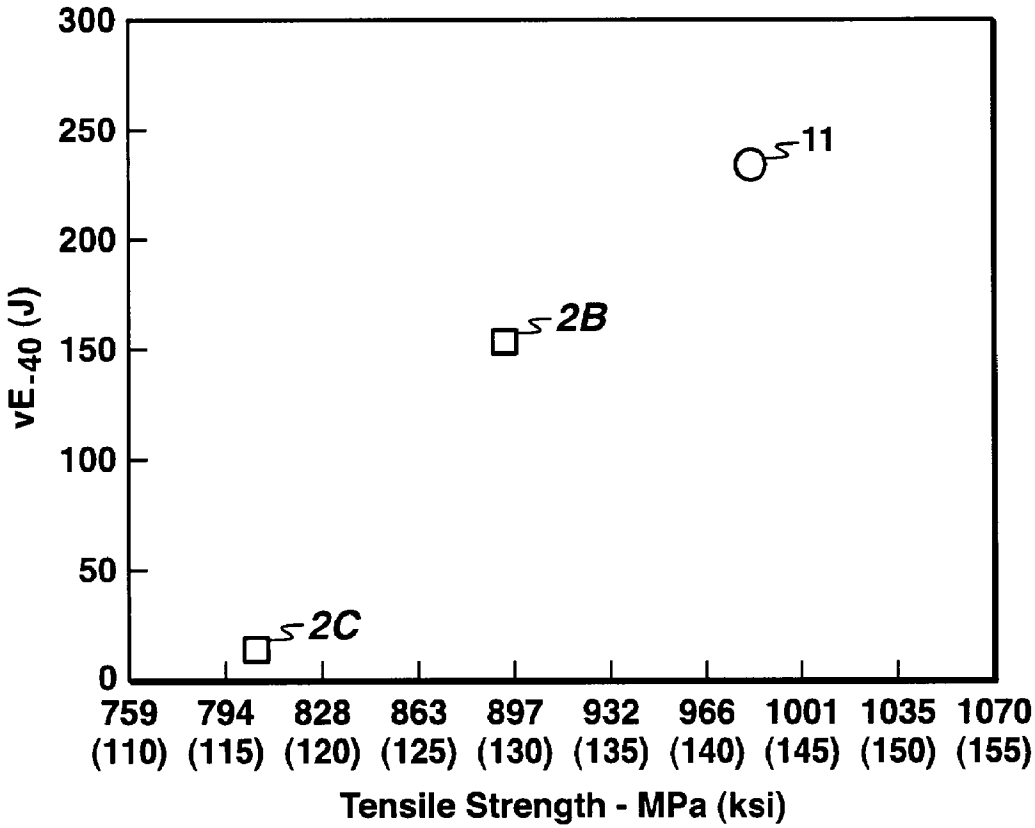

This high strength steel when subjected to heating in the 750° C. to 1050° C. temperature range and then conventionally air cooled to room temperature, undergoes an unacceptable degradation in strength and toughness. FIG. 2A shows the toughness and ultimate tensile strength of the base plate 11, steel hot formed at 760° C. and conventionally air cooled 2B, and steel hot formed at 1038° C. and conventionally air cooled 2C. As shown in FIG. 2A, losses between 69 MPa (10 ksi) and 207 MPa (30 ksi) in strength and between 100 J and 225 J of toughness are typical. This is due to the formation of non-optimum dual phase microstructures or embrittling ferrite, and martensite-austenite (M-A) constituents. This problem of diminished strength and toughness after hot forming becomes more acute as the strength of the starting material increases and as the hot forming temperature is increased.

As previously discussed, for the newer high strength steels of above 725 MPa UTS (105 ksi) a fitting with a yield strength of at least about 621 MPa (90 ksi) is desired. A new processing route has been developed for the newer high strength steels such that it can readily be implemented in existing fittings manufacturing facilities whereby the excellent mechanical properties of the linepipe steel are substantially preserved upon hot forming into fittings. In the new processing, plate or linepipe made from the new high strength steel is heated to the temperature required for hot forming, and then after forming, quenched in such a manner as to obtain optimum microstructures by minimizing or more preferably eliminating brittle phases or constituents.

The rapid cooling is accomplished by quenching in a fluid (gas or liquid) to achieve a cooling rate of at least about 10° C. per second to a quench stop temperature lower than about 450° C. The most common quenchants are plain water, water with various additives—brines or caustics usually, or oil (with or without various additives). Water polymer solutions are also used. Gaseous quenchants are inert gases including helium, argon and nitrogen. The preferred quenchant depends on the desired cooling rate. The ability to choose a quenchant based on the desired cooling rate is known in the art.

A post hot forming quenching processing route has been developed that enables the use of a higher strength base steel to achieve a fitting with a yield strength above 621 MPa (90 ksi), that retains high toughness after processing. A second advantage of this process is that it is more cost effective than the conventional hot forming, reheat, quench and temper process because it eliminates the reheat, quench and temper stages.

The microstructure of the hot formed steel according to this invention comprises predominantly ferrite, lath martensite, degenerate upper bainite, lower bainite, granular bainite, or mixtures thereof. The balance of the microstructure may include retained austenite, upper bainite, pearlite, martensite-austenite or mixtures thereof. The microstructure of these hot formed steel components provides high strength and superior low temperature toughness suitable for many cold weather applications down to at least −17° C. (0° F.).

As shown in FIG. 2A, heating the high strength steel base plate 11 to about 760° C. (2B) or about 1038° C. (2C) in a furnace and allowing it to conventionally air cool reduces the ultimate tensile strength from about 140 ksi to about 130 ksi and about 115 ksi respectively, but more importantly, reduces the toughness (i.e., Charpy-V-Notch toughness at −40° C., $vE_{-40}$, from about 230 J down to about 160 J and about 7J respectively).

A preferred embodiment of the present invention will be described below. This process involves hot forming at temperatures at the low end of the range used in conventional hot forming practices. FIG. 3A illustrates that heating high strength steel base plate (11), to 790° C. (3B and 3C), 770° C. (33), or 750° C. (35) and then hot water quenching instead of conventional air cooling produced a resultant material with an ultimate tensile strength of about 938 MPa (136 ksi) (3B and 3C), about 924 MPa (134 ksi) (33), and about 903 MPa (131 ksi) (35) respectively and fracture toughness of about 220 J (3B and 3C), about 180 J (33), and about 85 J (35) respectively. The yield strength of these materials would be in excess of 90 ksi. For comparison purposes, FIG. 3A illustrates that heating at 760° C. and conventional air cooling (2B) results in a steel with less tensile strength and toughness than the water quenched examples. Therefore, a preferred embodiment of the present invention would be to heat to about 790° C., hot form, and water quench the part after hot forming. In this manner, a high strength, high toughness component could be made.

Figure 4B:
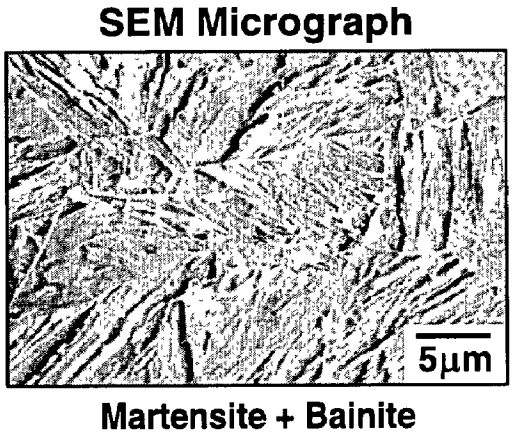
FIGS. 4A, 4B, and 4C illustrate the Charpy V-Notch toughness at −40° C., $vE_{-40}$, vs. ultimate tensile strength and the corresponding microstructures for a high strength steel processed to simulate manufacture of high strength fittings hot formed at a temperature of about 1038° C. followed by quenching to ambient temperature.
Figure 4C:
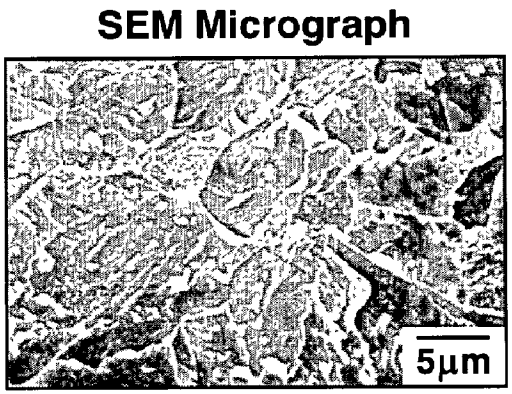
Figure 4A:
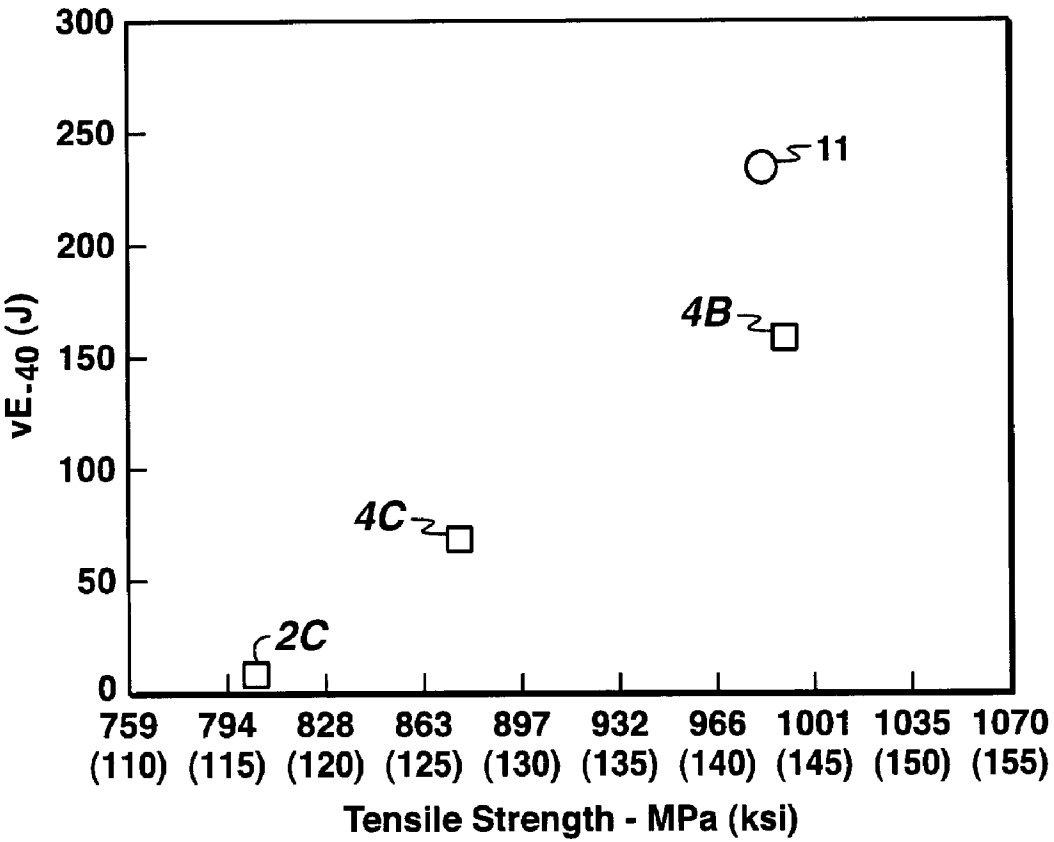

Another embodiment of the present invention for hot forming at temperatures at the high end of conventional hot forming temperatures is described in the following. FIG. 4A illustrates that heating the high strength steel base plate to 1038° C. and quenching in hot water (4B), according to this invention, produces a material with an ultimate tensile strength exceeding the initial base plate with a toughness of about 155 J. For comparison purposes, FIG. 4A illustrates that heating the high strength steel base plate to 1038° C. and conventionally air cooling (2C) produces a steel with significant losses in toughness and strength. Furthermore, heating the high strength steel base plate to 1038° C. and conventionally air cooling and then reheating to 900° C. followed by a hot water quench (4C) does not completely restore the significant loss of toughness and strength.

As previously stated, the new hot forming processes are more economical than conventional post hot forming strengthening by the reheat, quench and temper process. The reason for the improved economics is the elimination of the necessity for re-heating, quenching, and tempering the hot formed fitting, to achieve a quenched and tempered microstructure in the final component (high strength with improved toughness).

The high strength steels used as the starting material for the hot forming method have sufficiently high strength and toughness derived from an ultra-fine microstructure to allow the new processing of this invention to provide exceptional strength and toughness in the hot formed component. Therefore, starting with a lower strength material comprising a relatively coarse microstructure and practicing the same hot forming process would not result in a higher strength component.

Table 2 shows the degradation in toughness (Charpy V-Notch test at −40° C.) and ultimate tensile strength (UTS) as a result of different heating and cooling conditions. Due to the improved toughness that occurs as a result of heating the material to about 760 to 790° C., the preferred embodiment is to heat the material to as close to 760 to 790° C. as possible and then quench into a fluid (e.g., hot water).

TABLE 2

| Condition | Average UTS | CVN at −40° C. |
|---|---|---|
| Base Metal | 973 MPa (142 ksi) | 240 J |
| Heated to 760° C. and then air cooled | 877 MPa (128 ksi) | 155 J |
| Heated to 1038° C. and then air cooled | 790 MPa (115 ksi) | 7 J |
| Heated to 790° C. and water quenched | 932 MPa (136 ksi) | 220 J |
| Heated to 1038° C. and water quenched | 979 MPa (143 ksi) | 155 J |

EXAMPLES

The present invention will now be described by way of example. FIGS. 2A, 2B, and 2C compare the microstructure and mechanical properties of the high strength steel after heating and cooling according to conventional fittings processing. Also shown in this plot are the properties of the as received base plate 11. The microstructure produced in the steel plate after being heated to 1038° C. and air-cooled plate (2C) was coarse ferrite and martensite-austenite (M-A) as shown in the micrograph (FIG. 2C) obtained in a Scanning Electron Microscope (SEM). This conventional processing resulted in very poor toughness, and a significant deterioration in strength. Whereas, the steel plate heated to approximately 760° C. (2B) and air-cooled, produced a non-optimum ferrite and martensite dual phase microstructure (FIG. 2B) wherein the degradation in strength and toughness relative to those of the base plate was significantly less than that created by heating the steel to the higher temperature (1038° C.).

Figure 3B:
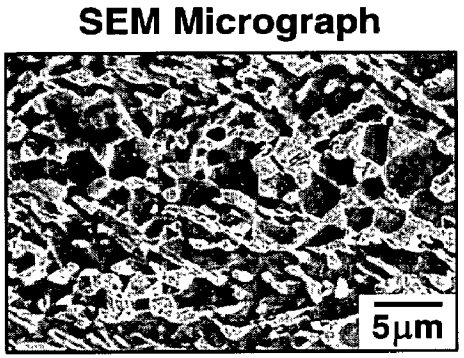
FIGS. 3A, 3B, and 3C illustrate the Charpy V-Notch toughness at −40° C., $vE_{-40}$, vs. ultimate tensile strength and the corresponding microstructures for a high strength steel processed according to the present invention.
Figure 3C:
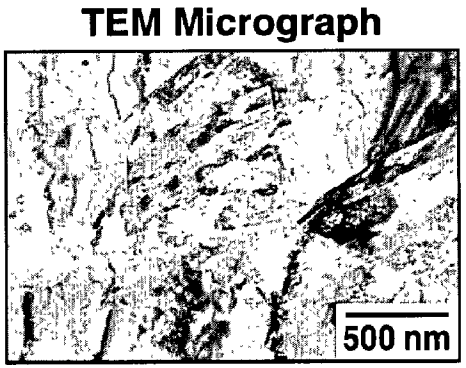
Figure 3A:
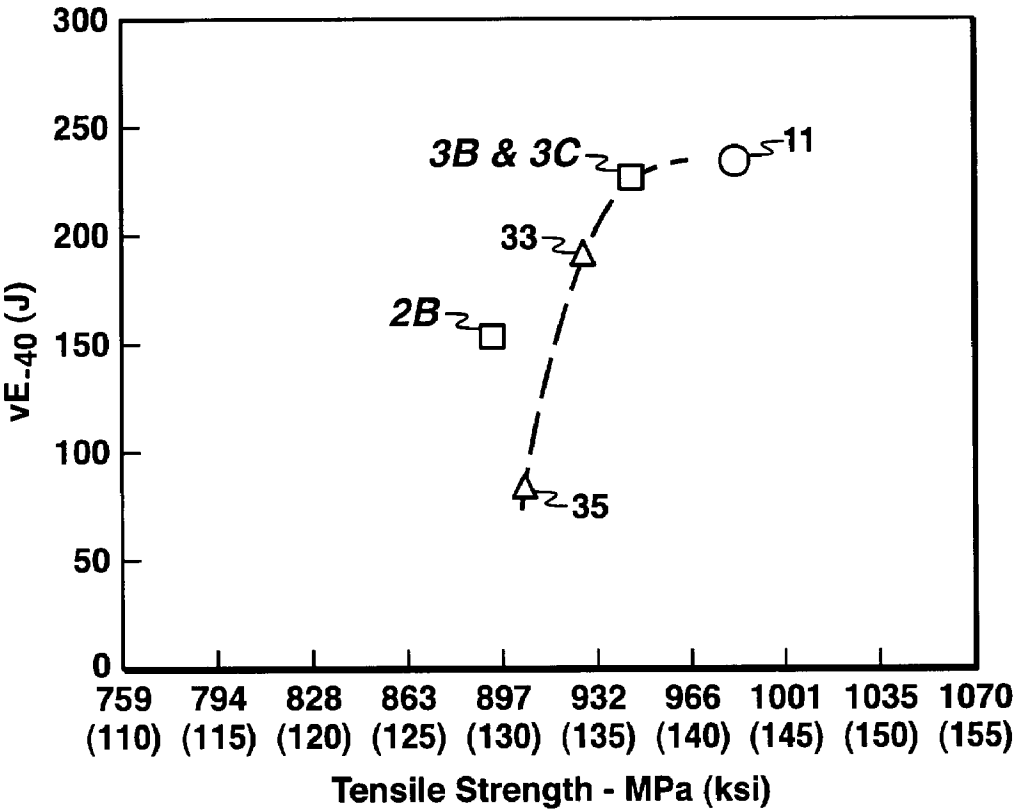

A preferred dual phase processing results in the microstructure and properties in the steel shown in FIGS. 3A, 3B, and 3C. FIG. 3A illustrates, one of the preferred embodiments of this invention. The high strength steel plate 11 is heated in a furnace to approximately 790° C. and quenched in hot water (3B and 3C) to ambient temperature. The hot water quenching provides a cooling rate of between about 10° C./s to about 30° C./s. This processing results in a very fine and well developed dual phase microstructure comprising a fine dispersion of martensite particles in a ferrite matrix as seen in the SEM (FIG. 3B) and Transmission Electron Microscope (TEM) (FIG. 3C) photographs illustrating the microstructures. A preferred embodiment of the fine dual phase microstructure is that the average martensite particle spacing should be less than about 10 microns. The strength and toughness properties as can be seen from the plot of FIG. 3A are very close to those of the as-received base plate.

However, lowering the temperature to about 770° C. (33) or about 750° C. (35) and hot water quenching reduces the ultimate tensile strength slightly. Below about 770° C., there is a significant loss in toughness. These property degradations are attributed to the formation of non-optimum ferrite-martensite dual phase microstructures, especially for hot forming temperatures below about 770° C. As discussed previously, air cooling a 760° C. hot formed component 2B (i.e., conventional processing) also results in a significant loss in toughness and tensile strength. Therefore, the preferred embodiment is a hot water quenching after hot forming.

As shown in FIG. 4A, heating at a higher temperature of approximately 1038° C. and quenching in hot water 4B, produces a martensite and bainite microstructure (FIG. 4B) with strength exceeding that of the as-received plate. However, the toughness is not quite restored. It has been found in the present invention that quenching to ambient temperature following hot deformation is essential in the fittings manufacture to achieve toughness properties close to those of the base plate or linepipe steel. The hot forming processing methods developed in this invention in conjunction with the new high strength steel should result in the fabrication of fittings with strength and toughness far in excess of any fittings made to date, and should eliminate the necessity of using lower strength fittings in conjunction with transition pieces in a pipeline. Also shown in FIG. 4A is a steel component heated to 1038° C., conventionally air cooled and then reheated to about 900° C. followed by a hot water quench 4C. The 900° C. reheated and quenched component, comprising a ferrite and martensite microstructure (FIG. 4C), has poor tensile strength and poor toughness. This illustrates that hot water quenching after the material has gone through an air cooling process is inadequate to restore properties of the high strength steel.

Although the embodiments discussed above are primarily related to the beneficial effects of the inventive process when applied to linepipes (e.g., oil and gas pipelines), this should not be interpreted to limit the claimed invention, which is applicable to any situation in which hot formed high strength steel components are used. Steps for creating hot formed high strength steel components have been provided and those skilled in the art will recognize that many applications not specifically mentioned in the examples will be equivalent in function for the purposes of this invention.

Glossary of terms:

| | |
|---|---|
| cooling rate: | cooling rate at the center, or substantially at the center, of the plate thickness; |
| CTOD: | crack tip opening displacement; |
| J | joules; |
| ksi: | thousand pounds per square inch; |
| MA: | martensite-austenite; |
| MPa: | megapascal; |
| Pcm: | a well-known industry term used to express weldability; |

-continued

| Glossary of terms: | |
|---|---|
| | also, Pcm = (wt % C + wt % Si/30 + (wt % Mn + wt % Cu + wt % Cr)/20 + wt % Ni/60 + wt % Mo/15 + wt % V/10 + 5 (wt % B)); |
| predominantly: | at least about 50 volume percent; |
| quenching: | accelerated cooling by any means whereby a fluid selected for its tendency to increase the cooling rate of the steel is utilized, as opposed to air cooling; |
| QST: | quench stop temperature, or the highest, or substantially the highest, temperature reached at the surface of the plate after quenching is stopped. The temperature tends to rise after quenching has stopped because of heat transmitted from the mid-thickness of the plate; |
| SEM: | scanning electron microscope; |
| slab | a piece of steel having any dimensions; |
| TEM: | transmission electron microscope; |
| TMCP: | thermo-mechanical controlled rolling processing; |
| UTS: | ultimate tensile strength or in tensile testing, the ratio of maximum load to original cross-sectional area; |
| YS: | Yield Strength or the net stress that can be applied to a material without permanent deformation of the material. |

We claim:

1. A method of hot forming high strength steel, said high strength steel having a yield strength of at least 689 MPA (100 ksi) to produce a hot formed component with a toughness as measured by Charpy-V-Notch impact test at −40° C. of at least about 120 joules (90 ft-lbs), said method comprising:

a) heating said high strength steel to at least about 700° C. and no more than about 1100° C.;

b) hot forming said high strength steel to produce a desired hot formed component, wherein said desired hot formed component comprises non-regular shaped pieces of pipe that are adapted to provide at least one of a change in pipeline direction, a coupling of different diameter pipes, splitting of the pipeline into two directions and any combination thereof;

c) quenching said high strength steel component after hot forming at a rate greater than about 10° C./s to a quench stop temperature lower than about 450° C.

2. The method of claim 1 wherein said hot formed high strength steel component is quenched in a fluid chosen based on providing a desired cooling rate.

3. The method of claim 1 wherein said high strength steel is predominantly comprised of fine lath martensite, fine lower bainite, fine granular bainite, fine degenerate upper bainite and any combination thereof.

4. The method of claim 1 wherein said high strength steel has an ultra-fine microstructure with an average grain size, in the through thickness direction, of less than about 10 microns.

5. The method of claim 1 wherein said high strength steel used is produced by a thermo-mechanical controlled rolling processing technique.

6. The method of claim 1 wherein said high strength steel used is weldable having a Pcm of less than or equal to 0.35.

7. The method of claim 1 wherein said hot formed high strength steel component has an ultimate tensile strength of at least about 725 MPa (105 ksi).

8. The method of claim 1 wherein said hot formed high strength steel component has a substantially uniform microstructure comprising predominantly fine-grained lower bainite, fine-grained lath martensite, or mixtures thereof.

9. The method of claim 1 wherein said hot formed high strength steel component has a fine dual phase microstructure of predominantly fine ferrite and martensite, such that the average martensite particle spacing is less than about 10 microns.

10. The method of claim 1 wherein said hot formed high strength steel component has an ultimate tensile strength of at least about 794 Mpa (115 ksi).

11. The method of claim 1 wherein said pieces of pipe are used to couple linepipes together.

12. A method comprising:

providing high strength steel plate having a yield strength of at least 689 MPA (100 ksi);

heating the high strength steel plate to at least about 700° C. and no more than about 1100° C.; and hot forming the high strength steel plate to produce a fitting, wherein fitting has a toughness as measured by Charpy-V-Notch impact test at about −40° C. of at least about 120 joules (90 ft-lbs).

13. The method of claim 12 comprising quenching the fitting after hot forming at a rate greater than about 10° C./s to a quench stop temperature lower than about 450° C.

14. The method of claim 12 wherein the fitting is not subjected to post-forming heat treatments to increase the toughness of the fitting.

15. The method of claim 12 wherein the high strength steel plate has an ultra-fine microstructure with an average grain size, in the through thickness direction, of less than about 10 microns.

16. The method of claim 12 wherein the high strength steel plate is weldable and has a Pcm of less than or equal to 0.35.

17. The method of claim 12 wherein the fitting has an ultimate tensile strength of at least about 725 MPa (105 ksi).

18. The method of claim 12 wherein the fitting has a substantially uniform microstructure comprising predominantly fine-grained lower bainite, fine-grained lath martensite, or combinations thereof.

19. The method of claim 12 wherein the fitting has a fine dual phase microstructure of predominantly fine ferrite and martensite and an average martensite particle spacing is less than about 10 microns.

* * * * *